US006883458B2

(12) United States Patent
Huse

(10) Patent No.: US 6,883,458 B2
(45) Date of Patent: Apr. 26, 2005

(54) BOAT SET ASSEMBLY

(75) Inventor: Ovie Clarence Huse, Mineral Wells, TX (US)

(73) Assignee: Moeller Marine Products, Twinsburg, OH (US)

( * ) Notice: Subject to any disclaimer, the term of this patent is extended or adjusted under 35 U.S.C. 154(b) by 0 days.

(21) Appl. No.: 10/838,585

(22) Filed: May 4, 2004

(65) Prior Publication Data

US 2004/0200400 A1 Oct. 14, 2004

Related U.S. Application Data

(62) Division of application No. 10/271,442, filed on Oct. 16, 2002.

(60) Provisional application No. 60/329,845, filed on Oct. 16, 2001.

(51) Int. Cl.[7] ..... B63B 17/00

(52) U.S. Cl. ..... 114/363; 297/65; 297/341; 297/344.11

(58) Field of Search ..... 114/363; 297/65, 297/244, 311, 317, 340, 341, 344.1, 344.11, 118

(56) References Cited

U.S. PATENT DOCUMENTS 3,394,417 A 7/1968 O'Link
4,544,199 A 10/1985 Wrigley
4,637,081 A 1/1987 Clark
5,746,152 A 5/1998 Huse
5,799,605 A 9/1998 Huse
6,056,239 A 5/2000 Cantu et al.
6,142,558 A 11/2000 May
6,336,619 B1 1/2002 Wahls
6,352,309 B1 3/2002 Beroth
6,416,130 B1 7/2002 Yamada

*Primary Examiner*—Sherman Basinger
(74) *Attorney, Agent, or Firm*—Howard & Howard

(57) ABSTRACT

A boat seat assembly having a seating platform including first and second seat bottoms and first and second seat backs, a seat mechanism for moving the seating platform between the flat position and the seating position, a base supporting the mechanism, and a positioning system for maintaining the seating platform in the seating position and for allowing the seat platform to move to the flat position. The seat mechanism includes a track and first and second sliders supported by the track for rectilinear movement for moving the seating platform between the seating position and the flat position. The positioning system includes a locking device for locking the first slider in various rectilinear positions relative to the track.

18 Claims, 4 Drawing Sheets

BOAT SET ASSEMBLY

RELATED APPLICATION

This patent application is a divisional of U.S. patent application Ser. No. 10/271,442, that was filed on Oct. 16, 2002, which in turn claims priority to and all the benefits of U.S. provisional patent application Ser. No. 60/329,845, that was filed on Oct. 16, 2001.

TECHNICAL FIELD

The subject invention relates to a boat seat assembly and more particularly to a boat seat assembly moveable between a seated position and a reclining position.

BACKGROUND OF THE INVENTION

Typical convertible boat seats have a metal framework supporting a bed mattress wherein the metal framework is collapsed when not in use. However, these seats are cumbersome to set up and do not allow an operator to adjust the seating assembly into various positions. Seating units that do allow adjustment of seating positions are typically connected with a rivot joint which can often pinch an operator during seat adjustment. Additionally, independent pieces are commonly attached directly to a base which increases the difficulty of manufacturing the assembly within tolerance. Finally, the attachment of a seat cushion to the assembly often occurs via attachment plates disposed at the outer edge of each cushion causing a lack of support in the center seat.

SUMMARY OF THE INVENTION AND ADVANTAGES

A boat seat assembly moveable between a seating position and a flat position and having a seating platform including first and second seat bottoms and first and second seat backs, the seat backs being hinged together, the first seat bottom being hinged to the first seat back, the second seat bottom being hinged to the second seat back. The assembly further includes a mechanism for supporting the seating platform and for moving the seating platform between the flat position with the seat backs aligned with the seat bottoms and the seating position with the seat backs disposed in a back-to-back relationship and extending upwardly from the seat bottoms and the seat bottoms moved closer together. A positioning device is also provided for maintaining the seating platform in the seating position and for allowing the seat platform to move to the flat position. A locking device has a locking member for preventing movement of the first and second seat bottoms when the seating platform is in the seating position and allows the first and second seat bottoms to both move rectilinearly while maintaining the seating platform in the seating position. The locking device further includes a handle coupled to the locking member for moving the locking member between engaged and disengaged positions.

BRIEF DESCRIPTION OF THE DRAWING

Advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
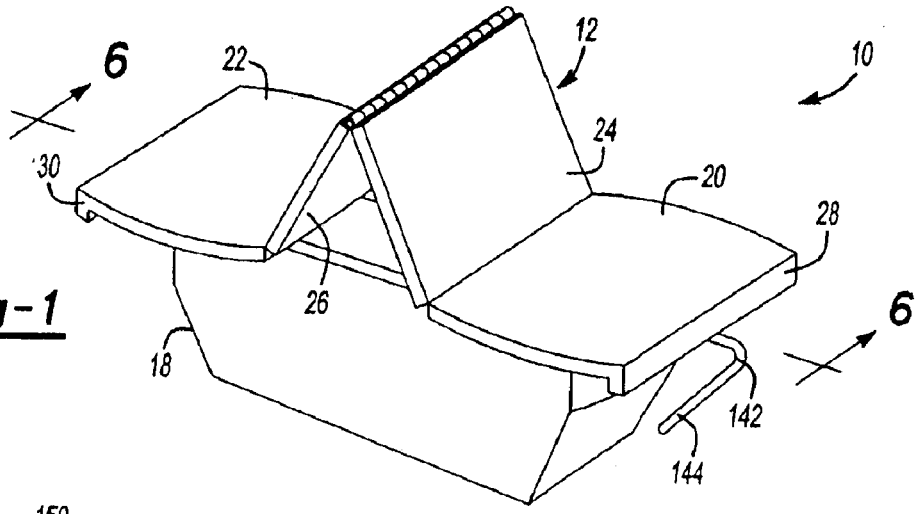
FIG. 1 is a perspective view of a boat seating assembly in a seated position.

Referring to the Figures, wherein like numerals indicate like or corresponding parts throughout the multiple views, a boat seat assembly moveable between a seating position and a flat position, is shown generally at 10.

The assembly 10 includes a seating platform, generally indicated at 12, a seat mechanism, generally shown at 14, a positioning system, generally indicated at 16, and a base 18. The seating platform 12 includes first 20 and second 22 seat bottoms and first 24 and second 26 seat backs. The seat backs 24, 26 are hinged together. The first seat bottom 20 is hinged to the first seat back 24 and extends to an outer edge 28. The second seat bottom 22 is hinged to the second seat back 26 and extends to an outer edge 30.

The seat mechanism 14 supports the seating platform 12 and moves the seating platform 12 between the flat position and the seating position. In the flat position, the seat backs 24, 26 are aligned with the seat bottoms 20, 22. In the seating position, the seat backs 24, 26 are disposed in a back-to-back relationship and extend upwardly from the seat bottoms 20, 22, and the seat bottoms 20, 22 are moved closer together. The base 18 supports the mechanism 14 and has a length less than the distance between the outer edges 28, 30 of the seat bottoms 20, 22 in the seating position.

The seat mechanism 14 includes a track 32 and a first slider 34 supported by the track 32 for rectilinear movement for moving the seating platform 12 between the seating position and the flat position. The first slider 30 supports the first seat bottom 20 for movement forward and away from the second seat bottom 22.

The seat mechanism 14 includes a second slider 36 movably supported by the track 32 and supporting the second seat bottom 22 for moving the second seat bottom 22 toward and away from the first seat bottom 20 as the platform 12 moves between the seating position and the flat position.

The seat mechanism 14 includes a first stop 38, for limiting rectilinear movement of the first slider 34 relative to the track 32, and a second stop 40, for limiting rectilinear movement of the second slider 36 relative to the track 32.

A first hinge 42 interconnects the first seat bottom 20 and the first seat back 24. The first hinge 42 is connected to the first slider 34 via fasteners 43 and allows the first seat bottom 20 to rotate upwardly about the first hinge 42 to a reclining position. A second hinge 44 interconnects the second seat bottom 22 and the second seat back 26. The second hinge 44 is connected to the second slider 36 and allows the second seat bottom 22 to rotate upwardly about the second hinge 44 to a reclining position.

A first support plate 46 is rotatably supported on the first slider 34 for movement between a stored position and an upright position for supporting the first seat bottom 20 in the reclining position. A second support plate 48 is rotatably supported on the second slider 36 for movement between a stored position and an upright position for supporting the second seat bottom 22 in the reclining position.

The seat mechanism 14 further includes the positioning system 16 for maintaining the seating platform 12 in the seating position and for allowing the seat platform 12 to move to the flat position. The positioning system 16 includes a locking device, generally shown at 50, for locking the first slider 34 in various rectilinear positions relative to the track 32.

The positioning system 16 includes a positioning device 52, which is preferably a rail 52, for preventing rectilinear movement of one slider relative to the other slider in the seating position. The rail 52 is secured to the first slider 34 and extends into an overlapping relationship with the second slider 36. The rail 52 has an opening 54 therein, and the second seat bottom 22 includes a projection 56 for engaging the opening 54 in the rail 52 for maintaining the seating platform 12 in the seating position. The rail 52 is releasable by rotating the second seat 22 bottom upwardly from the flat position.

As best shown in FIGS. 1 through 4, the base 18 is a generally rectangular unit having a cavity 58 for receiving the track 32. The base 18 is traditionally mounted to a boat floor. However, the track 32 could also be mounted directly to the boat floor, wherein the boat floor would perform the function of the base 18. Preferably, the track 32 is attached to the base 18 by a plurality of fasteners.

The track 32 is generally U-shaped and includes a track base 60 and two longitudinal sides 62. Two track channels 64 are disposed along the longitudinal sides 62. A plurality of track grooves 66 are located within the track base 60. The track base 60 also includes a plurality of locking holes 68 for use in conjunction with the positioning system 16.

The track 32 receives the first 34 and second sliders 36. Each slider 34, 36 may be manufactured from the same mold, thereby reducing manufacturing time and cost. Each slider 34, 36 is substantially rectangular having a top 70, a first slider end 72, a second slider end 74, and two sidewalls 76 establishing a hollow interior. Each slider 34, 36 is essentially symmetric about a longitudinal axis running from the midpoint of the first slider end 72 through the midpoint of the second slider end 74. A lip 78 is integrally formed below the sidewalls 76 of each slider 34, 36 for engaging the track channels 64, thereby allowing the sliders 34, 36 to travel or slide the entire length of the track 32.

Figure 5:
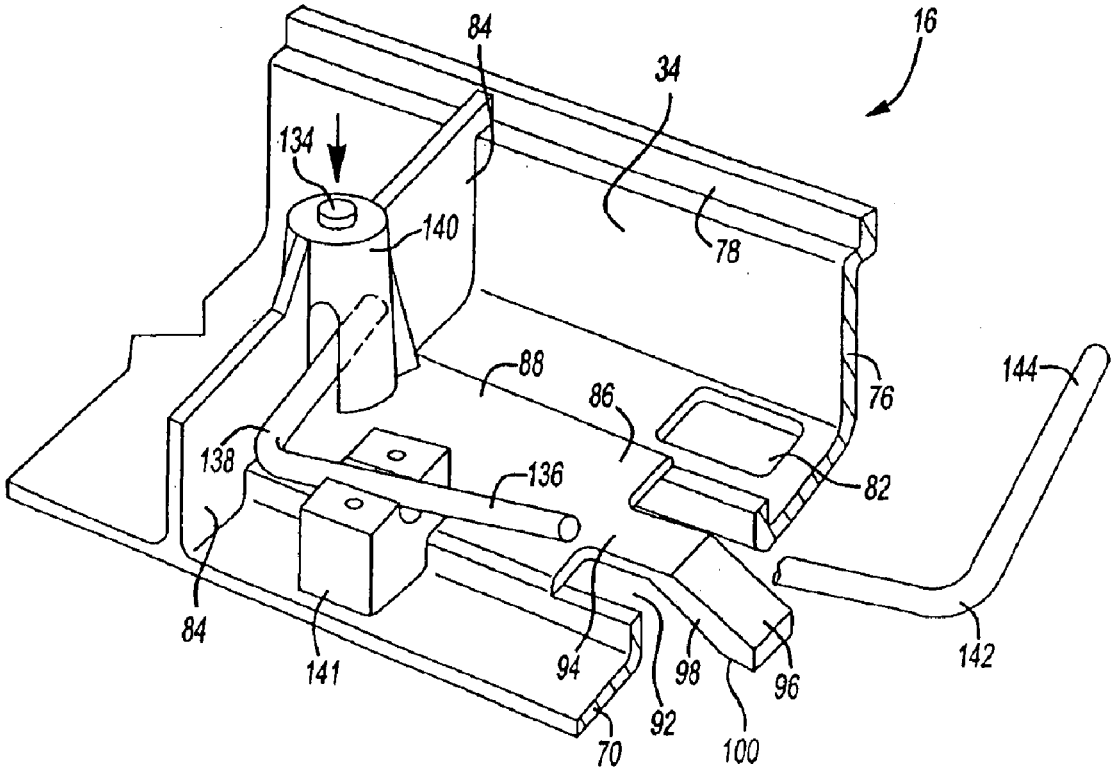
FIG. 5 is an exploded perspective view of a locking device of the boat seat assembly shown in an inverted position.

The stops 38, 40 protrude from the track 32 to prevent the slider 34, 36 from leaving the track 32. A plurality of slider openings 82 are disposed in the top 70 of the slider 34, 36 to prevent shrinkage and for ease in molding. A plurality of supporting members 84 disposed within the interior of the slider 34, 36 attach to the top 70 and each side wall 76 of the slider 34, 36 and extend downward to provide structural support when the boat seat assembly 10 is in use. FIG. 5 depicts a supporting member 84 surrounding the locking device 50.

Figure 4:
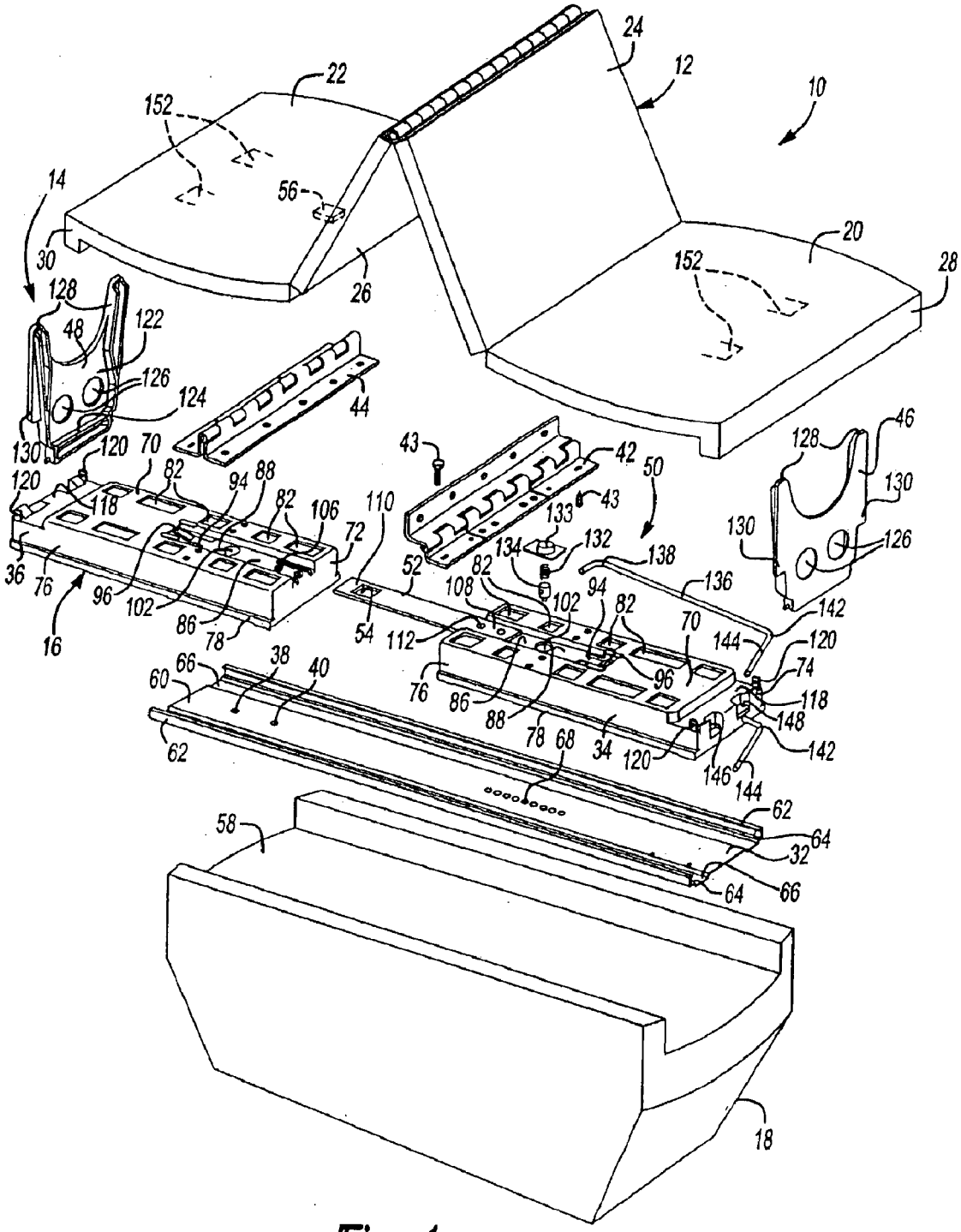
FIG. 4 is an exploded perspective view of the boat seat assembly in the seated position.
Figure 6:
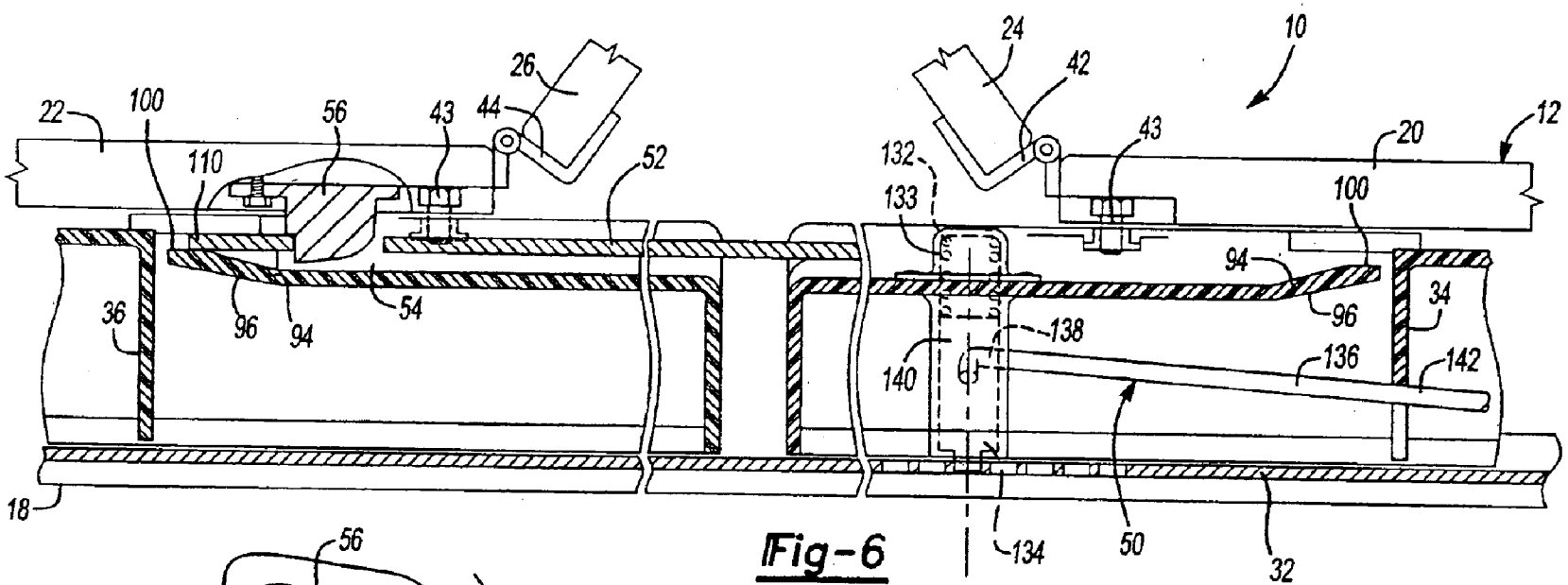
FIG. 6 is a cross-sectional fragmentary view of the boat seat assembly in a partially seated position.
Figure 7:
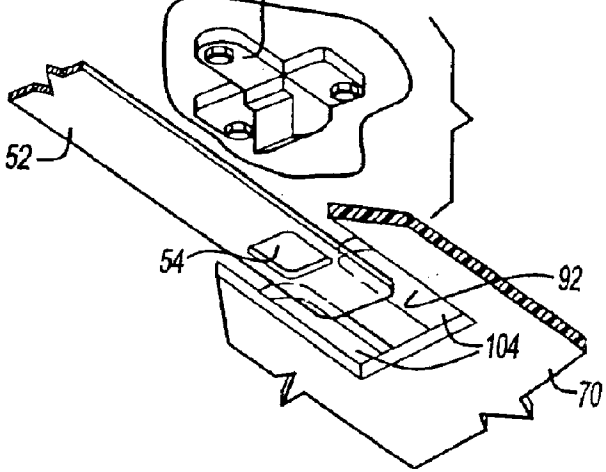
FIG. 7 is an exploded perspective view of a rail and a projection of the second slider.

A groove 86 having a groove base 88 runs longitudinally through the slider 34, 36 for receiving the rail 52. The rail 52 connects the first slider 34 and the second slider 36 via the second seat bottom 22. While the preferred embodiment employs the features described herein to receive the rail 52, it should be appreciated that any appropriate assembly can be utilized. As shown in FIGS. 4, 5, and 6, a tab 94 is disposed within an aperture 92 and is centrally anchored to the groove base 88. An upwardly inclining ramp 96 having an incline angle attaches to the tab 94. Two ribs 98 are placed symmetrically on either side of the upwardly inclining ramp 96. Each rib 98 generally follows the incline angle of the upwardly inclining ramp 96. At an inclined end of the upwardly inclining ramp 96 each rib 98 levels off, thereby forming a flat surface 100 just below the top 70 of the slider 34, 36. The groove 86 further includes a keyway 102 for receiving the locking device 50. In the preferred embodiment, two securing discs 104 integrally formed into the top 70 of the slider 34, 36 partially cover the aperture 92 for maintaining proper positioning of the rail 52. However, any method of securing the rail 52 may be used. At least one groove attachment hole 106 is disposed within the groove 86.

The rail 52, having a first rail end 108 and a second rail end 110, includes at least one rail attachment hole 112 near the first rail end 108. When the assembly 10 is assembled, the groove attachment hole 106 aligns with the rail attachment hole 112 such that a fastener can extend through each hole 106, 112 and connect the rail 52 to the groove base 88 of either the first slider 34 or the second slider 36. The rail 52 extends beyond the first slider end 72 of the slider 34, 36 to which it is connected and into the groove 86 of the other slider 34, 36. The opening 54 is disposed at the second rail end 110 for securing the first slider 34 to the second slider 36 as explained further below.

The top 70 of the slider 34, 35 is truncated near the second slider end 74 creating a ledge 118. The support plate 46, 48 connected to the ledge 118 rotates about a pair of plate hinges 120. A plate recess 122 having a recess edge 124 formed in the support plate 46, 48 is shaped substantially the same as the top 70 of the slider 34, 36 for resting thereon when the support plate 46, 48 is not in use. The surface of the support plate 46, 48 has a plurality of plate holes 126 and two arms 128 arcuately connected and extending away from the plate hinges 120. Two wings 130 extend from the sides of the support plate 46, 48 to aid in rotation.

Turning to FIGS. 3–6, the locking device 50 is disclosed in greater detail. FIG. 5 shows, for descriptive purposes, the locking device 50 in an inverted position. The locking device has a spring 132, a biasing cap 133, and a locking member 134. preferably illustrated as a post 134. The post 134 engages the track 32. More specifically, the post 134 is housed within the keyway 102 of the groove 86 of either one of the first 34 or second 36 slider. In the preferred embodiment, the locking device 50 is located within the slider 34, 36 to which the first rail end 108 is attached.

As best seen in FIGS. 4 and 5, a rod 136 includes a first rod end 138 disposed within a housing 140 and supported by a support block 141, and a second rod end 142 defining a handle 144. The handle 144 extends longitudinally within the slider 34, 36 through the second slider end 74 such that the handle 144 is disposed outside of the slider 34, 36. For illustrative purposes, the rod 136 is shown in both exploded and assembled views in FIG. 4. The preferred embodiment includes a pair of end notches 146 disposed within the second slider end 74 with one end notch 146 having a rod opening (not shown) for receiving the rod 136. A securement device 148 maintains proper positioning of the rod 136. Preferably, the securement device 148 is a disc fastened within the end notch 146 receiving the rod 136, thereby covering the rod opening to secure the rod 136.

The post 134 engages one of the plurality of locking holes 68 in the track base 60 to prevent movement of the slider 34, 36 along the track 32. To release the post 134, a force is applied to the handle 144, thereby actuating the spring 132 and raising the post 134 from the locking hole 68. The slider 34, 36 is then free to travel along the track 32 until the handle 144 is released and the post 134 engages the same locking hole 68 or another of the plurality of locking holes 68.

Referring to FIG. 1, each seat back 24, 26 and seat bottom 20, 22 is substantially the same size as a cushion 150 comprising foam padding or a similar cushioning material which is attached thereto. By attaching the cushion 150 to the back 24, 26 and bottom 20, 22 instead of using attachment plates disposed at the outer edges of the cushion 150, the amount of support provided to an operator is substantially increased. Each back 24, 26 and bottom 20, 22 is hingedly connected to at least one other back 24, 26 and bottom 20, 22 in series. A plurality of recesses and a plurality of holes can be disposed within each back 24, 26 and bottom 20, 22. The recesses create surface friction, and the holes optimize molding and prevent shrinkage. In the preferred embodiment, a ridge is disposed about the perimeter of the back 24, 26 and bottom 20, 22 for attaching a seat fabric.

The seat bottom 20, 22 is fixed to the top 70 of one of the first slider 34 or the second slider 36 via the hinges 42, 44. The seat back 24, 26 is hingedly connected to at least one seat bottom 20, 22. The seat bottom 20, 22 further includes an attachment ramp 152 for engaging the arms 128 of the support plate 46, 48. The attachment ramp 152 is disposed within one or more of the recesses of the seat bottom 20, 22. One or more of the recesses may also include a barrier which blocks the arms 128 of the support plate 46, 48 so that the seat bottom 20, 22 cannot engage the support plate 46, 48 at that recess.

In the preferred embodiment, the first slider end 72 of each of the first and second sliders 34, 36 are positioned immediately adjacent to one another. The two track channels 64 receive the lips 78 of the first slider 34 and the second slider 36. A portion of each supporting member 84 rests partially within the track grooves 66. Preferably, the first slider 34 includes the locking device 50 and the first rail end 108. The locking device 50 is thus housed within the keyway 102 of the groove 86 of the first slider 34. Additionally, with the first rail end 108, being fixedly attached to the groove base 88 of the first slider 34, the second rail end 110 extends into the groove 86 of the second slider 36. The first seat bottom 20 fastens to the first slider 34 and hingedly connects to the first seat back 24. The first seat back 24 hingedly connects to the second seat back 26. The second seat back 26 hingedly connects to the second seat bottom 22. The second seat bottom 22, having the projection 56 for engaging the rail 52, is fastened to the second slider 36 such that it can rotate about the second slider 36. Utilizing the track 32 to connect the individual seat bottoms 20, 22 and backs 24, 26 of the assembly 10 and not connecting each seat bottom 20, 22 and back 24, 26 directly to the base 18 substantially reduces or eliminates tolerance concerns.

In the seated position, best shown in FIGS. 1 and 6, the rail 52 extends into the groove 86 of the second slider 36 and comes to rest upon the flat surface 100 formed atop the upwardly inclining ramp 96 with the securing discs 104 preventing improper positioning. The projection 56 of the second seat bottom 22 engages the opening 54 of the rail 52 preventing separation of the first 34 and second slider 36. FIG. 4 also illustrates the seating platform 12 in a seated position. However, for illustrative purposes, the rail 52 is shown spaced from the groove 86 of the second slider 36.

Each support plate 46, 48 rests upon the corresponding slider 34, 36 when the seating platform 12 is in the seated position. Similarly, the first seat bottom 20 rests upon the first slider 34 and the second seat bottom 22 rests upon the second slider 36. The first 24 and second 26 seat backs rotate about the hinges 42, 44 between the first 20 and second 22 seat bottoms, respectively, such that the angle between the first seat back 24 and bottom 20 and the angle between the second seat back 26 and bottom 22 preferably approaches 90 degrees. This configuration necessarily forces the first 24 and second 26 seat backs into a substantially upright position wherein two seated operators sitting back-to-back are provided with back support. Additionally, a locking effect provided by the interaction of the projection 56 and the opening 54 prevents the seating assembly 10 from changing position without warning.

As appreciated, if the post 134 of the locking device 50 rests in one of the plurality of locking holes 68 in the track 32, the first slider 34 cannot move along the track 32. Because the first 34 and second sliders 36 are joined by the rail 52 in the seated position, movement of the second slider 36 is also restrained when the post 134 engages a locking hole 68. However, if a force is applied to the handle 144 of the locking device 50 to actuate the spring 132 and release the post 134, the first and second sliders 34, 36 may slide as a unit along the track 32 in either longitudinal direction.

Figure 2:
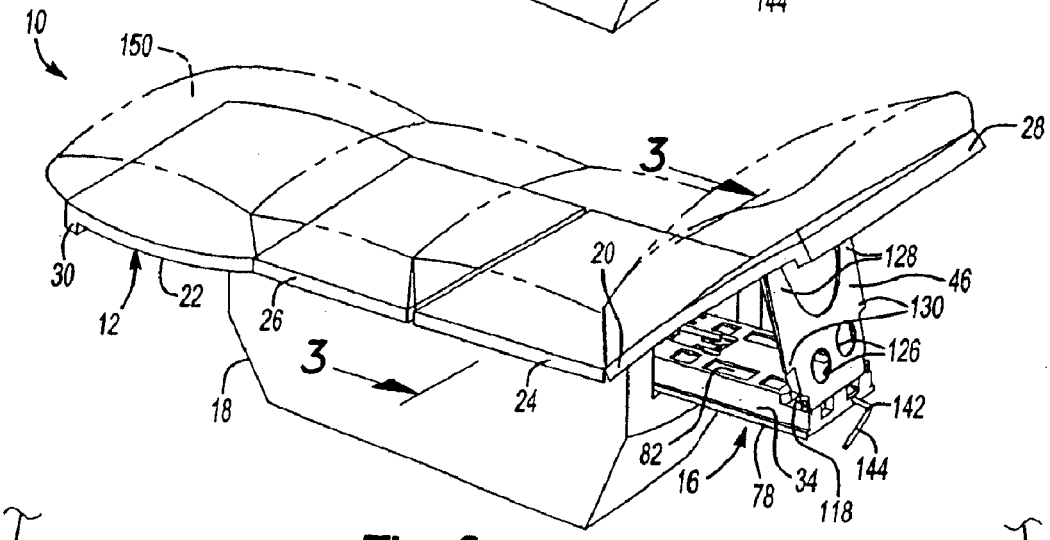
FIG. 2 is a perspective view of the boat seating assembly in a reclining position.
Figure 3:
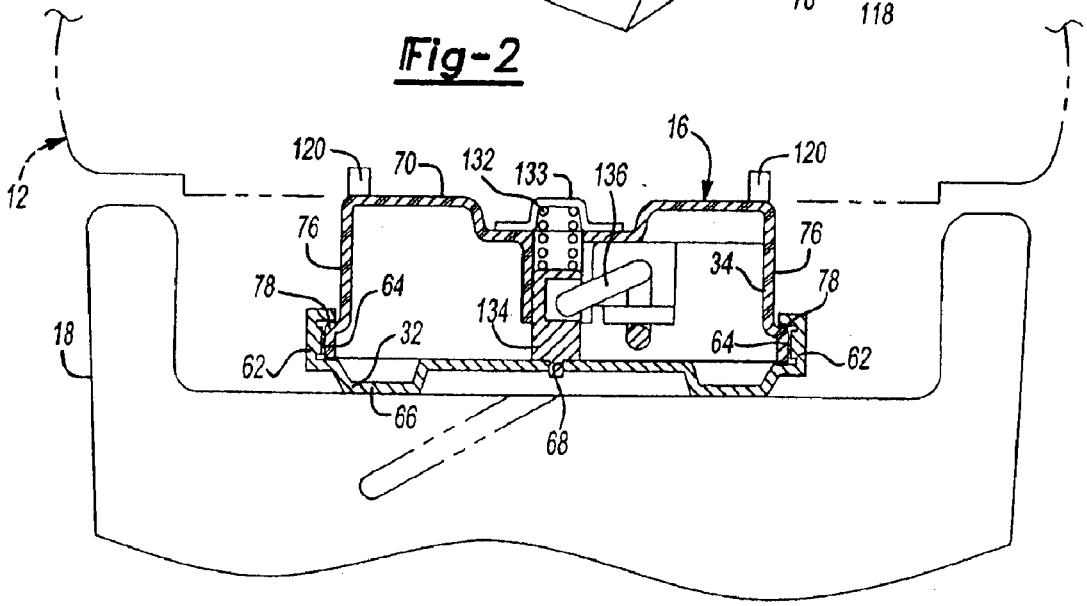
FIG. 3 is a fragmentary cross-sectional side view of the boat seat assembly of FIG. 1.

A full reclining position is achieved when each of the first 20 and second 22 seat bottoms and first 24 and second 26 seat backs rests flat upon the corresponding sliders 34, 36. FIG. 2 shows a reclining or lounging position in which the first 24 and second 26 seat backs and second seat bottom 22 rest flat while the first seat bottom 20 is angled upward as described in further detail below. To release the rail 52 in the preferred embodiment to achieve the reclining position, the second seat bottom 22 is rotated away from the second slider 36 to force the projection 56 out of the notch 116 in the rail 52. With the rail 52 released, the first 34 and second 36 sliders move independently of each other. The second slider 36 moves along the track 32 pulling the first 24 and second 26 seat backs therewith. The stops 38, 40 contact the first slider end 72 of the second slider 36 before the first 24 and second 26 seat backs are positioned flat against the sliders 34, 36. However, it should be appreciated that a frame not including a stop 38, 40 would allow full extension of the assembly 10 through movement of only one of the sliders 34, 36. The first 24 and second 26 seat backs reach the full reclining position in the preferred embodiment by moving the first slider 34 along the track 32 in the direction opposite the second slider 36. As appreciated, movement of the first slider 34 requires operation of the locking device 50 to release the post 134. The lounging position results when the support plate 46, 48 is rotated away from the corresponding slider 34, 36 such that the arms 128 engage the attachment ramp 152 of one or both of the first 20 and second 22 seat bottoms.

The invention has been described in an illustrative manner, and it is to be understood that the terminology that has been used is intended to be in the nature of words of description rather than limitation. It will be apparent to those skilled in the art that many modifications and variations of the present invention are possible in light of the above teachings. Therefore, it is to be understood that the invention may be practiced otherwise than as specifically described.

What is claimed is:

1. A boat seat assembly comprising:

a seating platform including first and second seat bottoms and first and second seat backs with said seat backs being hinged together, said first seat bottom being hinged to said first seat back, and said second seat bottom being hinged to said second seat back;

a seat mechanism for supporting said seating platform and for moving said seating platform between a flat position with said seat backs aligned with said seat bottoms and a seating position with said seat backs extending upwardly from said seat bottoms and said seat bottoms moved closer together;

said seat mechanism including a track and first and second sliders movably supported by said track, said first slider supporting said first seat bottom for rectilinear movement forward and away from said second seat bottom as said platform moves between said seating position and said flat position, and said second slider supporting said second seat bottom for rectilinear movement forward and away from said first seat bottom as said platform moves between said seating position and said flat position;

a positioning device secured to at least one of said first and second sliders for coupling said sliders together and preventing rectilinear movement of said sliders relative to each other when said seating platform is in said seating position in order to maintain said seating platform in said seating position, and allowing movement of said sliders relative to each other to move said seating platform toward said flat position; and a locking device secured to one of said sliders with said locking device including a locking member engaging said track to prevent movement of said coupled sliders when said seating platform is in said seating position and disengaging said track to allow said coupled sliders to both move rectilinearly relative to said track while maintaining said seating platform in said seating position with said locking device further including a handle coupled to said locking member for moving said locking member between said engaged and disengaged positions with said handle being spring biased to continuously bias said locking member toward said engagement with said track.

2. A boat seat assembly as set forth in claim 1 further including a first hinge interconnecting said first seat bottom and said first seat back with said first hinge connected to said first slider for allowing said first seat bottom to rotate upwardly about said first hinge to a reclining position.

3. A boat seat assembly as set forth in claim 2 further including a second hinge interconnecting said second seat bottom and said second seat back with said second hinge connected to said second slider for allowing said second seat bottom to rotate upwardly about said second hinge to a reclining position.

4. A boat seat assembly as set forth in claim 3 further including a first support plate rotatably supported on said first slider for movement between a stored position and an upright position for supporting said first seat bottom in said reclining position.

5. A boat seat assembly as set forth in claim 4 further including a second support plate rotatably supported on said second slider for movement between a stored position and an upright position for supporting said second seat bottom in said reclining position.

6. A boat seat assembly as set forth in claim 1 wherein said seat mechanism includes a first stop for limiting rectilinear movement of said first slider relative to said track and a second stop for limiting rectilinear movement of said second slider relative to said track.

7. A boat seat assembly as set forth in claim 1 wherein said positioning device is further defined as a rail secured to said first slider and releasably mounted to said second slider with said rail preventing said rectilinear movement of one slider relative to the other slider when said seating platform is in said seating position.

8. A boat seat assembly as set forth in claim 7 wherein said rail extends from said first slider into an overlapping relationship with said second slider and allows movement of one slider relative to the other slider by rotating one of said first and second seat bottoms upwardly from said flat position to release said rail from said second slider.

9. A boat seat assembly as set forth in claim 8 wherein said rail includes an opening and said second seat bottom includes a projection for engaging said opening to maintain said seating platform in said seating position.

10. A boat seat assembly as set forth in claim 1 further including a base supporting said seat mechanism and having a length less than the distance between said outer edges of said seat bottoms in said seating position.

11. A boat seat assembly as set forth in claim 1 wherein said track includes a plurality of holes and said locking member engages said holes to prevent movement of said coupled sliders.

12. A boat seat assembly as set forth in claim 11 wherein said locking member is further defined as a post that is complementary in configuration with said holes.

13. A boat seat assembly comprising:

a seating platform including first and second seat bottoms and first and second seat backs with said seat backs being hinged together, said first seat bottom being hinged to said first seat back, and said second seat bottom being hinged to said second seat back;

a seat mechanism for supporting said seating platform and for moving said seating platform between a flat position with said seat backs aligned with said seat bottoms and a seating position with said seat backs extending upwardly from said seat bottoms and said seat bottoms moved closer together;

said seat mechanism including a track and first and second sliders movably supported by said track, said first slider supporting said first seat bottom for rectilinear movement forward and away from said second seat bottom as said platform moves between said seating position and said flat position, and said second slider supporting said second seat bottom for rectilinear movement forward and away from said first seat bottom as said platform moves between said seating position and said flat position;

a positioning device secured to at least one of said first and second sliders for coupling said sliders together and preventing rectilinear movement of said sliders relative to each other when said seating platform is in said seating position in order to maintain said seating platform in said seating position, and allowing movement of said sliders relative to each other to move said seating platform toward said flat position; and a locking device secured to one of said sliders with said locking device including a locking member engaging said track to prevent movement of said coupled sliders when said seating platform is in said seating position and disengaging said track to allow said coupled sliders to both move rectilinearly relative to said track while maintaining said seating platform in said seating position with said locking device further including a handle coupled to said locking member for moving said locking member between said engaged and disengaged positions;

wherein said track includes a plurality of holes and said locking member engages said holes to prevent movement of said coupled sliders.

14. A boat seat assembly as set forth in claim 13 wherein said locking member is further defined as a post that is complementary in configuration with said holes.

15. A boat seat assembly as set forth in claim 13 wherein said handle is spring biased to continuously bias said locking member toward said engagement with said holes in said track.

16. A boat seat assembly as set forth in claim 13 wherein said positioning device is further defined as a rail secured to said first slider and releasably mounted to said second slider with said rail preventing said rectilinear movement of one slider relative to the other slider when said seating platform is in said seating position.

17. A boat seat assembly as set forth in claim 16 wherein said rail extends from said first slider into an overlapping relationship with said second slider and allows movement of one slider relative to the other slider by rotating one of said first and second seat bottoms upwardly from said flat position to release said rail from said second slider.

18. A boat seat assembly as set forth in claim 17 wherein said rail includes an opening and said second seat bottom includes a projection for engaging said opening to maintain said seating platform in said seating position.

* * * * *